US005649702A

United States Patent [19]

Janes et al.

[11] Patent Number: 5,649,702

[45] Date of Patent: Jul. 22, 1997

[54] SPORTS RACQUET WITH SPIN-ENHANCING CROSS-SECTION

[75] Inventors: Richard Janes, Burlington Township, N.J.; Stephen J. Davis, Washington Crossing, Pa.

[73] Assignee: Prince Sports Group, Inc., Bordentown, N.J.

[21] Appl. No.: 636,625

[22] Filed: Apr. 23, 1996

[51] Int. Cl.[6] ..... A63B 49/02

[52] U.S. Cl. ..... 473/537; 473/546

[58] Field of Search ..... 273/73 R, 73 C, 273/73 D, 73 G

[56] References Cited

U.S. PATENT DOCUMENTS

| | | | |
|---|---|---|---|
| 5,009,422 | 4/1991 | Soong | 273/73 C X |
| 5,014,987 | 5/1991 | Soong | 273/73 C |
| 5,080,361 | 1/1992 | Blanc et al. | 273/73 C |
| 5,211,691 | 5/1993 | Sol | 273/73 C |
| 5,306,004 | 4/1994 | Soong | 273/73 C |
| 5,312,102 | 5/1994 | Stennett | 273/73 C |
| 5,562,283 | 10/1996 | Davis et al. | 273/73 G |

FOREIGN PATENT DOCUMENTS

| | | | |
|---|---|---|---|
| 3018354 | 11/1981 | Germany | 273/73 D |
| 2191706 | 12/1987 | United Kingdom | 273/73 D |

*Primary Examiner*—Raleigh W. Chiu
*Attorney, Agent, or Firm*—White & Case

[57] ABSTRACT

A sports racquet has a head portion with an elliptical cross-section in which the major axis is oriented parallel to the string plane. Preferably, the racquet includes a pair of converging throat frame members, and a throat bridge, which also have elliptical cross-sections oriented parallel to the string plane. As an alternative to a conventional throat bridge, in which some of the main strings are secured to the sides of the frame, a power ring, which bows inwardly toward the strung surface, spans the throat area, and supports the all the main strings, which are wrapped therearound. The racquet provides improved playability for hitting spin shots, by reducing wind resistance and reducing the minimum required angle of incidence (making it easier to hit the ball). Also, the hoop strength of the racquet is increased, which is particularly advantageous when using a power ring, which needs to provide tension to all the main strings.

11 Claims, 6 Drawing Sheets

SPORTS RACQUET WITH SPIN-ENHANCING CROSS-SECTION

FIELD OF INVENTION

The present invention relates to sports racquets, in particular tennis and squash racquets.

BACKGROUND OF THE INVENTION

The popularity of racquet sports has increased significantly over the past 20 years. This has been due, at least in part, to advances in racquet design. For example, in the 1970's Prince® introduced the large head tennis racquet, based on its U.S. Pat. No. 3,999,756, which made the game easier and more enjoyable to play. Since that time, advances in lightweight composite materials, and the introduction of widebody frame profiles, have allowed racquet frames to become lighter and stiffer, which allows players of all skill levels to hit the ball with greater speed and accuracy and thus derive even more enjoyment from the game.

The larger head of modern day tennis racquets also provides a greater ability for players to hit spin shots, and tennis instructors increasingly teach spin shots as a way to improve the player's game. Thus, rather than hitting a "flat" shot, in which the racquet head merely moves forward to meet the ball, a player swings the racquet so that, at the time of ball impact, the racquet head is also moving upwardly (to impart a topspin), or downwardly (to impart an underspin), or sideways (to impart a slice), or various combinations thereof.

Balls hit with a spin are harder to return because they curve during flight and because the spin alters the angle at which the ball bounces. Because an opponent does not know how the ball is spinning, it is more difficult for opposing players to anticipate the flight and bounce, and position themselves properly to hit a strong return, than in the case of a flat shot.

Topspin ground strokes are particularly desirable. Topspin tends to cause the ball to curve downwardly toward the opponent's court. Thus, it is easier to hit shots deep, because the spin helps ensure that the ball will land inside the baseline. Moreover, when a ball hit with topspin bounces, it tends to kick forward, due to the spin, which means that opponents need to retreat deeper to hit the return. The fact that an opponent will be hitting a deep return means that a topspin shot, placed deep, does not need to be hit hard to be effective, which in turn makes topspin shots easier to hit.

FIG. 1 illustrates the execution of a topspin forehand. The player swings the racquet forward so that, as the ball approaches, the racquet is below the level of the ball, as shown by position "A". The swing motion continues by moving the racquet in a forward and upward direction, as shown by the arrow, from positions "A" to "C", to intersect the path of movement of the ball. During the swing, the racquet head remains generally in a vertical position, so that, at the moment of ball impact, when the racquet has reached position "B", the forward component of racquet movement causes the ball to rebound in the direction of the opponent's court, while at the same time, the upward component of racquet movement imparts a clockwise (looking in the direction of FIG. 1) topspin.

The widebody design frame, in which the cross-sectional height is substantially greater than the cross-sectional width, produces higher out-of-plane bending stiffness (i.e., bending stiffness in a direction perpendicular to the string bed), which results in increased hitting power when hitting a flat serve or return. However, the increased frame height is a disadvantage when attempting to hit a spin shot.

One reason has to do with the fact that, in a spin shot, the path of movement of the frame needs to cross the path of movement of the ball. As shown in FIG. 2, in order for the ball to land on the strings, just prior to impact the upper side of the frame needs to cross the path of the ball, but at the time of impact the lower side of the frame must be below the ball path.

However, as shown by FIG. 3, which illustrates the movement of the ball relative to the string bed, just prior to impact, the ball must have a certain minimum angle of incidence e in order to avoid hitting the leading edge "le" of the frame. As can be seen from FIG. 3, the relatively large cross-sectional height "h" of a widebody frame increases the minimum necessary angle of incidence, making it harder to land the ball on the strings, during a spin shot, without hitting or grazing the sides of the frame. For example, in a racquet frame having a cross-sectional height "h" of 20 mm, an outside width of 285 mm, and a cross-sectional frame width of 8 mm, the minimum angle of incidence $\alpha$ would be 4.1°, assuming one could land the ball directly in the center "C" of the string bed. If the ball lands either above or below center "C", the angle $\alpha$ must be even greater (note that although a ball that hits the strings below center "C" could theoretically have an angle of incidence less than 4° and still miss the top of the frame, upon rebounding from the string bed it would hit the trailing edge "te" of the frame; thus the minimum angle of incidence must allow the ball both to hit the strings and rebound off the racquet without hitting the frame).

Another tradeoff of a widebody cross-section is that it increases the wind resistance of the racquet when attempting to hit spin shots. As described above, a spin shot utilizes a stroke in which the racquet head moves with a substantial component of motion parallel to the strings, i.e., tangential to tip of the frame head. During tangential motion (as opposed to motion perpendicular to the string bed), the broad side of the widebody profile faces into the wind, presenting a relatively large surface area. Because it is desirable to obtain maximum tangential head speed for spin production, the surface area of the side of the frame is extremely important. If the total surface area facing into the wind is large, as is the case with widebody frames, tangential head speed will be impaired.

SUMMARY OF THE INVENTION

A sports racquet according to the invention has a head portion with an elliptical cross-section in which, in contrast to conventional tennis racquets, the major axis is oriented parallel to the string plane. Preferably, the racquet includes a pair of converging throat frame members, and a throat bridge, which also have elliptical cross-sections oriented parallel to the string plane. As an alternative to a conventional throat bridge, in which some of the main strings are secured to the sides of the frame, a power ring, which bows inwardly toward the strung surface, spans the throat area, and supports the all the main strings, which are wrapped therearound.

The racquet provides improved playability for hitting spin shots, by reducing wind resistance and reducing the minimum required angle of incidence (making it easier to hit the ball). Also, the hoop strength of the racquet is increased, which is particularly advantageous when using a power ring, which needs to provide tension to all the main strings. Moreover, surprisingly, it has been found that the increased width of the frame has little or no adverse effect on a conventional flat serve or return.

For a better understanding of the invention, reference is made to the following detailed description of a preferred embodiment, taken in conjunction with the drawings accompanying the application.

DETAILED DESCRIPTION OF PREFERRED EMBODIMENTS

Figure 4:
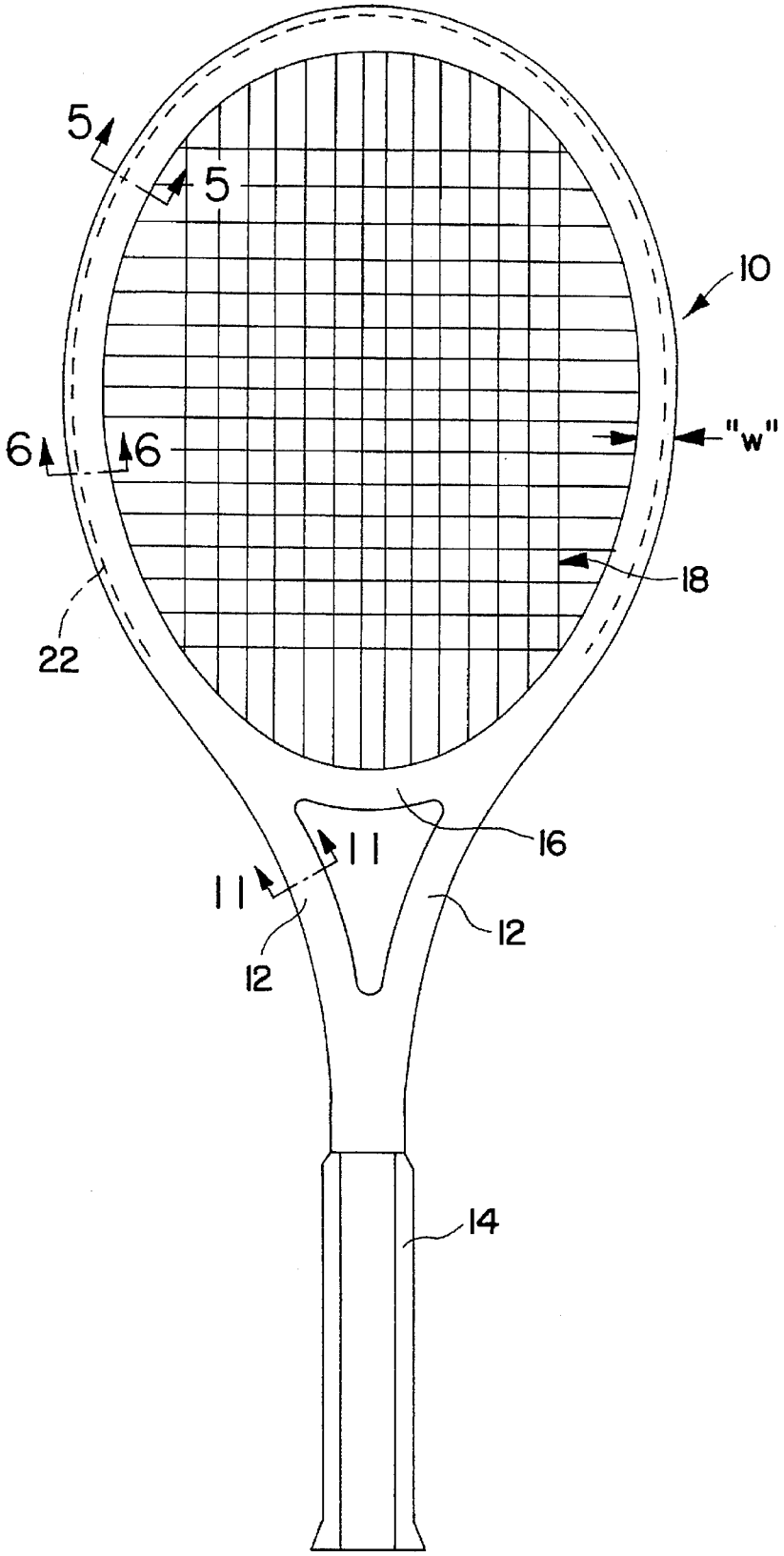
FIG. 4 is a front view of a tennis racquet according to the invention.

Referring to FIG. 4, a tennis racquet includes a generally elliptical head portion 10, a pair of converging throat frame members 12 extending from the ends of the head portion 10, and a handle 14 connected to the throat frame members 12. A throat bridge 16 spans the two throat frame members 12, where they join the respective ends of the head portion 10, to enclose a generally elliptical strung surface area containing interwoven strings 18. The general frame shape shown in FIG. 4 is conventional, and any desired frame shape may be employed. For example, a particularly desirable frame, in which the strung surface is egg-shaped, is disclosed in commonly owned U.S. Pat. No. 5,464,210. Also, the invention may be employed with a monoshaft frame, such as disclosed in commonly owned U.S. Pat. No. 5,417,418, and with extra long racquets, for example as disclosed in the '210 patent.

Figure 5:
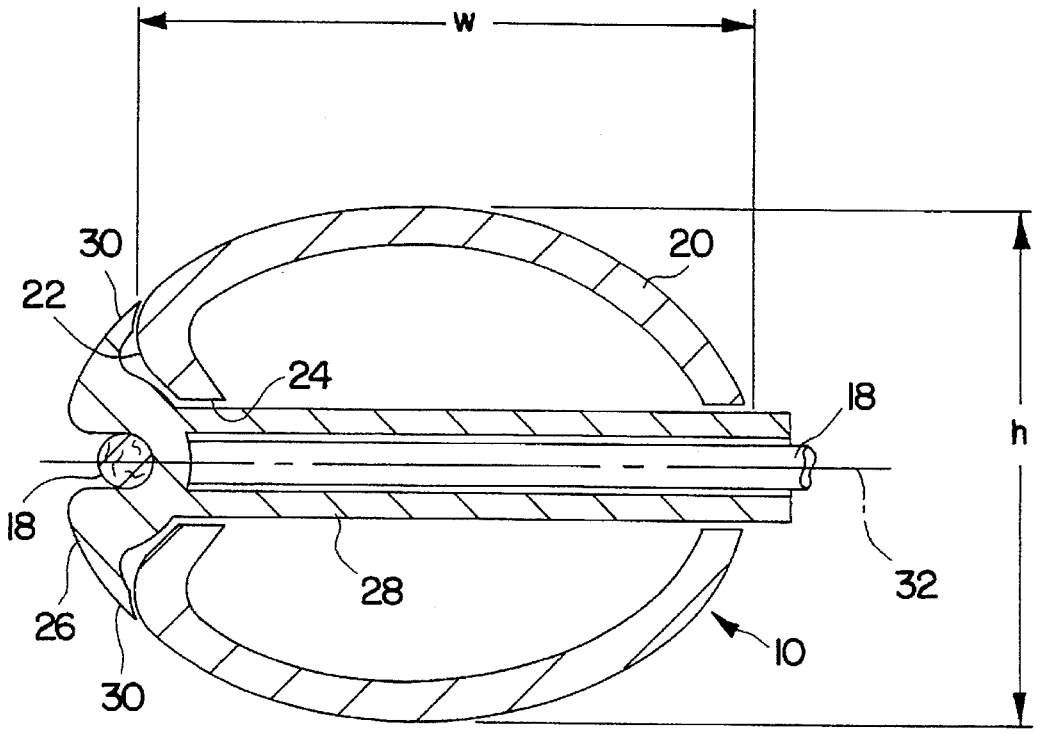
FIG. 5 is a cross-sectional view of the racquet, on an enlarged scale, taken through lines 5—5 of FIG. 4.
Figure 6:
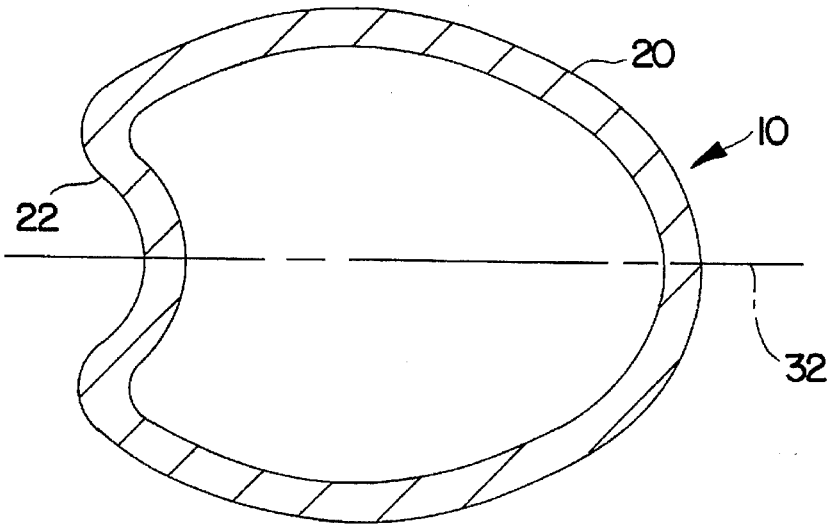
FIG. 6 is a cross-sectional view of the racquet frame, on an enlarged scale, taken through lines 6—6 of FIG. 4, in which the bumper grommet strip and strings have been omitted for clarity.

As shown in FIGS. 5 and 6, the head portion 10 is formed by a hollow, tubular frame 20. An outwardly facing stringing groove 22, and string holes 24, are formed in the frame 20 in a generally conventional manner. As shown in FIG. 5, a bumper strip 26 is positioned in the stringing groove 22. The bumper strip 26 acts as a seat for the strings 18, and includes grommet pegs 28 that extend through the string holes to surround the strings 18. Also, a pair of laterally extending flanges 30 overlie the outwardly facing surfaces of the frame 20 on either side of the stringing groove 22. The afore-described frame 20 and bumper strip 26 are generally conventional, except in their cross-sectional shapes, which will not be described.

As shown in FIGS. 5–6, the frame 20 is generally elliptical in cross-section. In FIG. 5, the cross-sectional height "h" is the dimension measured in the direction perpendicular to the string bed. The cross-sectional width "w" is the dimension measured parallel to the string bed. Unlike conventional racquet frames, in accordance with the present invention the major axis 32 of the ellipse is oriented parallel to the string plane, and in the preferred embodiment lies in the string plane. Thus, in the present invention the cross-sectional height "h" of the frame, at least in the head section, is less than the width "w". Most preferably, the height is less than 85% of the width.

Figure 11:
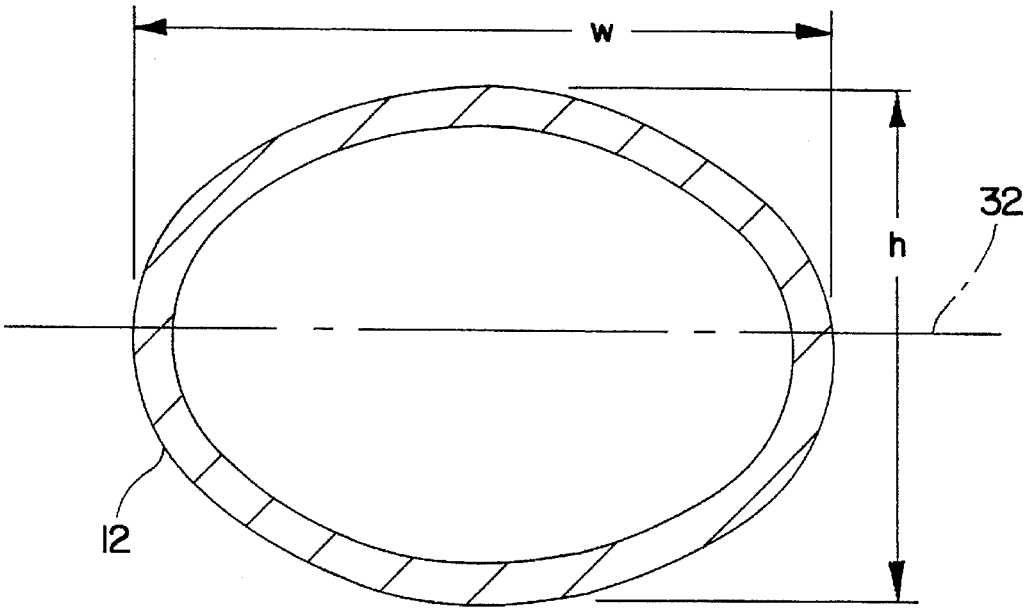
FIG. 11 is a cross-sectional view of the racquet frame, on an enlarged scale, taken through lines 5—5 of FIG. 4.

In the racquet of FIG. 4, the throat frame members 12 may have the same shape as head portion 20 (except that a stringing groove 22 is not needed). Thus, as shown in FIG. 11, the throat frame members 12 have an elliptical cross-section in which the major axis 32 is oriented parallel to the string bed 18. However, if desired the throat frame members 12 may be given other shapes. For example, it may be desirable to give members 12 a conventional widebody frame shape, so as to have a greater height than width, for increased racquet stiffness, or a round or other cross-sectional shape, depending upon the desired in-plane, out-of-plane, and torsional stiffness properties desired. Also, the cross-sectional shape of the throat frame member 12 need not be uniform along their lengths. For example, the height and/or width may taper in a direction toward or away from the handle.

It should be noted that giving the throat frame members 12 one of these latter cross-sectional shapes, i.e., in which the major axis is not oriented parallel to the string plane, is less aerodynamic when hitting a spin shot. But, during a spin shot, the throat travels much slower, in a direction parallel to the string bed, than the head, and therefore unless the height is increased very significantly, any increase in wind resistance would not be substantial. Moreover, because the ball does not hit the racquet in this region, there is no adverse effect due to the higher angle of incidence resulting from the higher frame. Thus, by giving the throat members 12 (or alternatively the shaft, in a monoshaft racquet) a different cross-sectional shape than the head, the advantages of the invention, in terms of improved aerodynamics for hitting spin shots, can be retained, while being able to select independently the desired strength and stiffness characteristics of the throat members 12.

The racquet frame may be formed using known composite materials and manufacturing processes. In an exemplary process for making a so-called "graphite" frame, sheets of uncured epoxy, containing carbon fibers embedded therein, are wrapped to form a flexible hollow tube which is placed inside a mold. A bladder, disposed inside the tube, is inflated to cause the tube to assume the shape of the mold, and at the same time the mold is heated to cure the epoxy resin. Such process offers the advantage that the cross-sectional height, width, and shape of the frame at any point may be varied as desired. Thus, rather than being uniform the height of the head portion 10 and throat members can be variable. For example, the frame height may have a constant taper profile, as disclosed in commonly owned U.S. Pat. No. 5,037,098.

By way of an exemplary embodiment, the racquet head portion 10 has a cross-sectional width "w" of 20 mm, and a height "h" of 15 mm. The cross-section is elliptical in shape such that, without a stringing groove, the oval would have a length, along its major axis, of 18 mm. The throat frame members 12 have a height "h" of 15 mm and a width of "w" of 20 mm.

Figure 7:
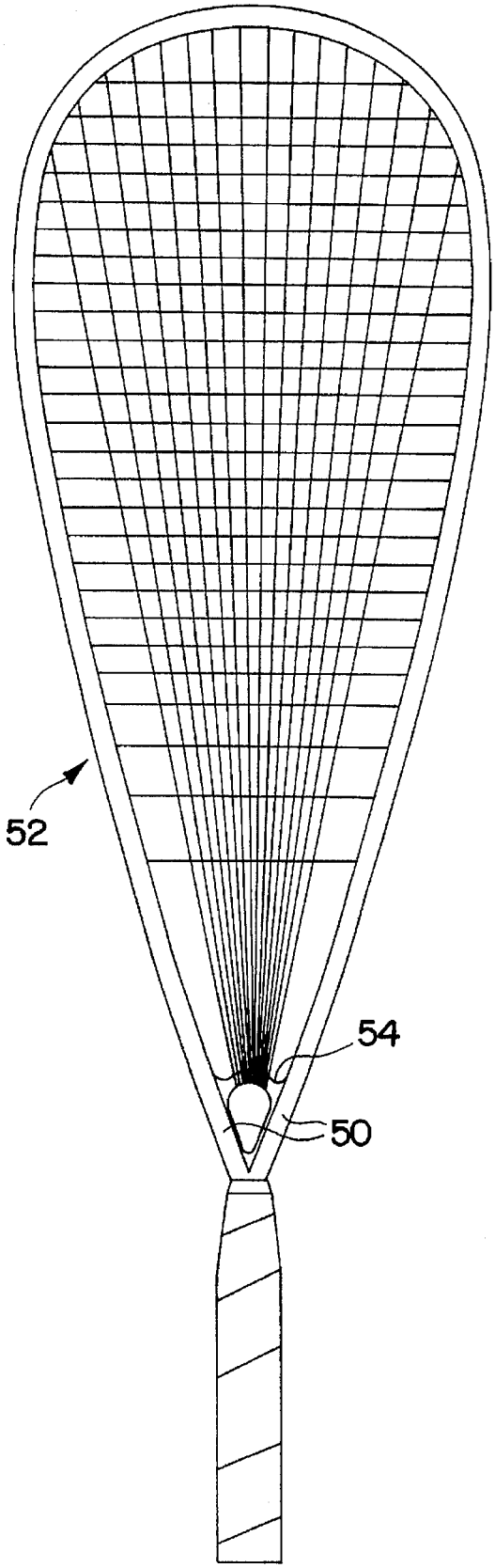
FIG. 7 is a front view of an alternative embodiment of a squash racquet.
Figure 8:
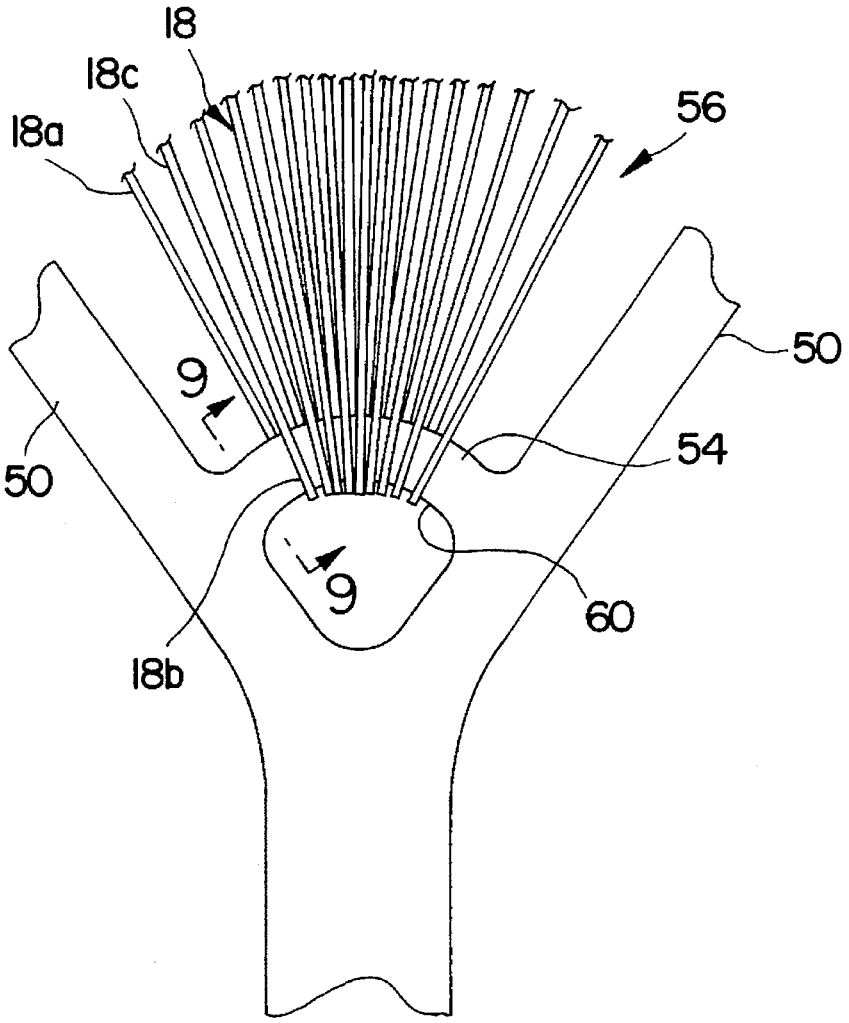
FIG. 8 is a full scale view of the throat section of the racquet of FIG. 7.
Figure 9:
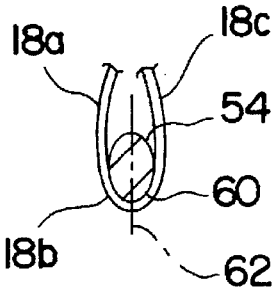
FIG. 9 is a cross-sectional view, taken through lines 9—9 of FIG. 8.

A second preferred embodiment of a sports racquet is shown in FIGS. 7–9. Rather than having a throat bridge completing a generally elliptical or ovoid shape strung surface area, the lower ends 50 of the head portion 52 are spanned by a power ring 54. As best seen in FIGS. 8–9, the power ring 54 is arcuate in shape, and bows inwardly toward the strung surface area 56. The power ring has a bearing surface 60, facing away from the strung surface area 56, that is curved in cross-section (as shown in FIG. 9). The power ring is preferably elliptical in cross-section, with its major axis 62 oriented in the plane of the strings 18, but alternatively may have round or other cross-sectional shapes.

In this embodiment the lower ends of the main strings are wrapped around the power ring 54. Thus, for example, the lower end of the main string 18*a* and the next adjacent main string 18*c* are connected by string segment 18*b*, which wraps around the curved bearing surface 60. By bowing the power ring 54 inwardly, toward the strung surface 56, when the strings are tensioned they will automatically seat in a predetermined position, without the need for string holes or other retention means.

The drawback of a power ring is that it must counteract the tension force of all the main strings. This is not the case in a conventional tennis racquet, where the throat bridge anchors only the center main strings, and the outlying main strings are anchored in the sides of the frame (see FIG. 4). In accordance with the preferred embodiment, in which the major axis of the power ring is oriented parallel to the string bed, the hoop strength of the power ring is increased, and thus the power ring can oppose a larger string tension force.

A frame constructed according to the present invention provides a number of advantages, particularly to players who rely significantly upon spin shots, which are summarized below.

Lower Wind Resistance

Figure 1:
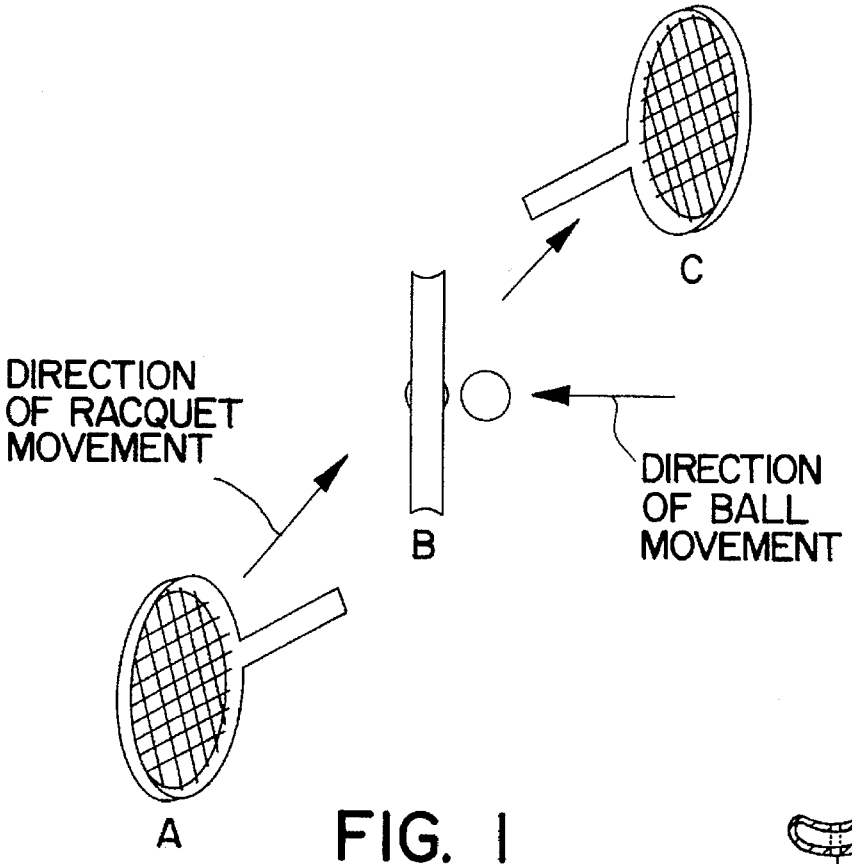
FIG. 1 is illustration of three positions of a tennis racquet during a topspin swing.
Figure 2:
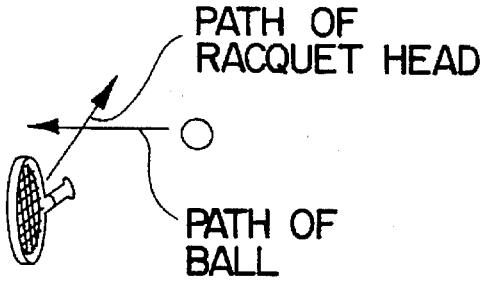
FIG. 2 is a side view showing a tennis racquet and ball, during a topspin swing, just prior to impact.

As described earlier in connection with FIG. 1, in order to hit an effective spin shot the racquet head needs to be moving, at the time of ball impact, relatively fast in a direction generally parallel to the string bed. Due to the smaller cross-sectional height "h" of the frame, there is less frame surface area facing the direction of movement, and the racquet head 10 will thus offer substantially less air resistance than conventional racquet frames, particularly wide bodies.

In a flat swing, the broadside of the frame, i.e., having the relatively larger width "w", will face into the wind. However, contrary to expectations, tests have shown that the increased surface area resulting from the larger width "w" has little effect, from the standpoint of increased wind resistance, on a normal flat swing. This is due to the fact that, in contrast to the fast, upward whipping motion of the racquet head needed to impart topspin, the forward motion of the racquet tends to more of a slow, steady motion.

Even in the case of a flat service, there is no significant difference in wind resistance. This is due to the biomechanics of the serve motion, in which the racquet travels on edge during most of the serve motion, pronating to a flat position only at the last moment prior to striking the ball. The present invention actually reduces the surface area facing the wind for most of the swing.

Thus, a racquet according to the invention provides a significant benefit when hitting spin shots, including topspin ground strokes, underspin ground strokes, and topspin serves. At the same time, the racquet exhibits little or no reduction in performance when hitting flat ground strokes or serves.

A Very Low Minimum Angle of Incidence

As discussed before, in hitting a spin shot it is necessary that the angle of incidence, at which the ball moves relative to the string bed, be kept above a certain minimum. The angle of incidence is determined by the speed and direction of the ball, and the speed and direction of the racquet head. Generally, the faster a racquet head is moving perpendicular to the ball direction, the lower the angle of incidence. Thus, it is greatly desirable to reduce the minimum required angle of incidence, because it potentially allows more spin to be put on the ball.

Figure 3:
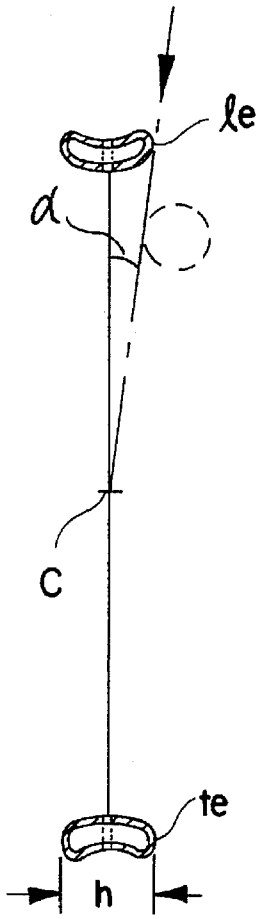
FIG. 3 is a side, schematic view of a racquet head showing the direction of ball movement, relative to the racquet string bed, during a spin shot.
Figure 10:
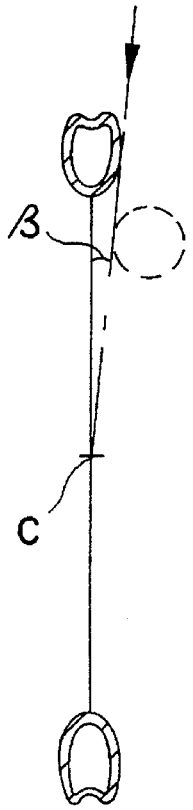
FIG. 10 is a side, schematic view of a racquet head, corresponding to FIG. 3, showing the direction of ball movement, relative to the racquet string bed, during a spin shot with a racquet according to the invention.

As shown in FIG. 3, the relatively high cross-section of a widebody frame requires a higher minimum angle of incidence $\alpha$ to ensure that the ball does not hit the frame. FIG. 3 can be contrasted with FIG. 10, which shows a comparable schematic drawing of the racquet according to the invention. As shown, the minimum angle of incidence $\beta$ of the invention is very low. For example, for a frame having the same outside width as the racquet in FIG. 3 (285 mm), and a cross-sectional width "w" of 19 mm, the minimum required angle of incidence is reduced from 4.1° (FIG. 3) to 3.0°.

Extremely High Hoop Strength

As is well known, increasing a cross-sectional dimension of a tubular member increases the bending strength in that direction. Modern day strings can be strung to a very high tension, e.g., 70 lbs. or higher, which places significant inward stress on the head. In accordance with the present invention, the frame profile is strengthened in a direction to oppose bending loads resulting from higher string tensions. Moreover, the racquet head is more resistant to cracking that can result from hitting the surface of the court during a swing or, in the case of squash or racquetball, from impact with the walls of the court.

Due to the racquet's increased in-plane (i.e., parallel to the string bed) stiffness, when hitting spin shots the racquet is more stable, and deforms less, from ball impact. Also, the direction of racquet bending is will defined.

The higher hoop strength is also advantageous during stringing of the racquet. When a racquet is strung, a stringing machine engages the racquet at several mounting positions located around the frame. As each string is tensioned, the string places a relatively high load on the frame at the two opposite locations where it is secured. Because all the strings are not tensioned at the same time, the stress applied to the racquet frame will not be uniform about the head, and the high string tensions tend to cause deformation of, and therefore stress on, the frame, which remains even after all the strings are tensioned. The present invention tends to reduce the amount of frame deformation caused during stringing.

Greater Relative Stability.

Conventional tennis racquets are normally available in "mid" or "mid-plus" size, which racquets generally have about a 95 square inch hitting area, or "oversize", where the head, and consequently the hitting area, are larger (typically 110 square inches). Oversize racquets offer the advantage that they are more stable on off-axis hits (i.e., they tend to twist less when the ball hits the strings away from the centerline of the string bed). However, because oversize racquets require a higher stringing tension, and can produce a "trampolining" effect, many players nevertheless prefer mid or mid-plus racquets.

As can be seen from FIG. 4, due to the increased cross-sectional width "w" of the frame 20, for any given outside diameter of the frame 20, the inside diameter of the frame 20 will be smaller than in a conventional racquet. Thus, in the case of a tennis racquet, a racquet having an outer head shape similar to a normal large head racquet (110 square inches) will have an internal head shape and dimension similar to a normal mid-plus racquet (97 square inches). Thus, a racquet according to the invention provides the benefit of an "oversize" racquet (in terms of increased stability), but without the drawbacks (trampolining and higher string tensions).

The foregoing represents preferred embodiments of the invention. Variations and modifications will be apparent to persons skilled in the art, without departing from the inventive concepts disclosed herein. For example, frame shapes other than those disclosed in the preferred embodiment may be employed, provided that the longer dimension is oriented parallel to the string bed. All such modifications and variations are intended to be within the skill of the art, as defined in the following claims.

We claim:

1. A sports racquet comprising a head portion, supporting strings located generally in a string plane, and a handle, wherein the head portion has an elliptical cross-section in which the major axis is oriented parallel to the string plane.

2. A sports racquet according to claim 1, wherein the head portion has a cross-sectional height, measured in a direction perpendicular to the string plane, and a cross-sectional width, measured along the major axis, and wherein the ratio of cross-sectional height-to-width is less than 0.85.

3. A sports racquet according to claim 2, wherein said racquet includes at least one frame member connecting said head and said handle, and wherein said frame member has an elliptical cross-section in which the major axis is oriented parallel to the string plane.

4. A sports racquet according to claim 2, wherein said racquet includes at least one frame member connecting said head and said handle, and wherein said frame member has an elliptical cross-section in which the major axis is oriented perpendicular to the string plane.

5. A sports racquet according to claim 2, wherein said racquet includes at least one frame member connecting said head and said handle, and wherein said frame member has a generally round cross-section.

6. A sports racquet according to claim 2, wherein said head portion includes a pair of opposite ends, and wherein said racquet further includes a pair of converging throat frame members connecting the respective ends to said handle, and a throat bridge spanning said throat frame members to enclose, with said head portion, a stringing area, and wherein said throat bridge has an elliptical cross-section in which the major axis is oriented parallel to the string plane.

7. A sports racquet according to claim 6, wherein said throat frame members have an elliptical cross-section in which the major axis is oriented parallel to the string plane.

8. A sports racquet according to claim 6, wherein said throat frame members have an elliptical cross-section in which the major axis is oriented perpendicular to the string plane.

9. A sports racquet according to claim 6, wherein said throat frame members have a generally round cross-section.

10. A sports racquet according to claim 1, wherein the head portion has opposite ends that join together at a throat joint; and further comprising:

a power ring spanning the opposite ends, above the throat joint, wherein the power ring is arcuate and bows inwardly toward the stringing area, wherein the head portion and power ring define a stringing area, wherein the power ring has an at least generally arcuate bearing surface facing away from the outer head portion which bows in a direction toward the stringing area, and wherein the power ring has a non-round cross-section having a major axis, and wherein the major axis is oriented parallel to the string plane; and a plurality of interwoven main strings and cross strings, wherein the main strings have upper and lower ends, wherein the lower ends of at least most of the main strings wrap around the bearing surface to be supported thereby.

11. A sports racquet according to claim 10, wherein the power ring cross-section is generally elliptical.

* * * * *